US007052380B2

(12) United States Patent
Weber

(10) Patent No.: US 7,052,380 B2
(45) Date of Patent: May 30, 2006

(54) SANDING STATION FOR A BELT SANDING MACHINE

(76) Inventor: Georg Weber, Friesener Strasse 27, Kronach (DE) 96317

( * ) Notice: Subject to any disclaimer, the term of this patent is extended or adjusted under 35 U.S.C. 154(b) by 0 days.

(21) Appl. No.: 10/914,099

(22) Filed: Aug. 7, 2004

(65) Prior Publication Data

US 2005/0136813 A1 Jun. 23, 2005

(30) Foreign Application Priority Data

Dec. 19, 2003 (DE) ..... 103 59 999
Jul. 30, 2004 (DE) ..... 10 2004 037 148

(51) Int. Cl.
*B24B 21/06* (2006.01)

(52) U.S. Cl. ..... 451/303; 451/311; 451/299

(58) Field of Classification Search ..... 451/303, 451/311, 309, 297, 308, 299, 300, 302, 304
See application file for complete search history.

(56) References Cited

U.S. PATENT DOCUMENTS 2,586,848 A * 2/1952 Miller ..... 451/303
2,904,937 A * 9/1959 Feurich ..... 451/303
3,570,190 A * 3/1971 Rutt et al. ..... 451/303

* cited by examiner

*Primary Examiner*—George Nguyen
(74) *Attorney, Agent, or Firm*—McCormick, Paulding & Huber LLP

(57) ABSTRACT

A sanding station for a belt sanding machine includes at least an endless sanding belt guided over deflection rollers and a pressure segment belt circulating within the sanding belt for pressing the sanding belt against the workpiece. The running direction of the pressure segment belt is oriented transversely to the running direction of the sanding belt.

8 Claims, 2 Drawing Sheets

SANDING STATION FOR A BELT SANDING MACHINE

CROSS-REFERENCE TO RELATED APPLICATIONS

This application is entitled to the benefit of and incorporates by reference in their entireties essential subject matter disclosed in Gernam Patent Application No. 103 59 999.1 filed on Dec. 19, 2003, and Gernam Patent Application No. 10 2004 037 148.2 filed on Jul. 30, 2004.

FIELD OF THE INVENTION

The invention relates in general to a sanding station for a belt sanding machine, and deals more particularly with a belt sanding machine having an endless sanding belt guided over deflection rollers and a pressure segment belt (Chevron™ belt, lamella belt) circulating within the endless sanding belt for pressing the sanding belt against the workpiece.

BACKGROUND OF THE INVENTION

Sanding stations of the before-mentioned type are known in various forms. They can be implemented with sanding belts running transversely or longitudinally to the transport direction of the workpiece. Several solutions are known for guiding the sanding belt and the pressure segment belt over rollers. Basically they differ from one another in that either the pressure segment belt and the sanding belt partly use the same deflection rollers or the pressure segment belt and the sanding belt use different deflection rollers. In the first case, the displacement of the two belts as a result of the different radius of the neutral fiber on the deflection rollers is fixed, whereas in the second case optionally different speeds can be set for the two belts and thus the displacement changes as well. Moreover, in this second case, it is known to orient the segments of the segmented belt diagonally with respect to the running direction of the segmented belt so that excessive running noise is prevented since a sanding contact on longitudinal edges of the workpiece does not take place abruptly.

Further, a sanding station is already known in which the wide belt running parallel to the transport direction of the workpiece is guided over three rollers, the segmented belt running within the sanding belt over two of the same deflection rollers and a separate third deflection roller. As a result, it is achieved that the segments of the sanding belt always come into contact with other sections of the sanding belt, however, the ratio with which the segments displace themselves relative to the sanding belt remains fixed so that after a certain running distance, the same segments will encounter the same point of the sanding belt. A desirable change in the sanding surface by changing the displacement is not possible. Further, the irregular wear on the segmented belt which normally occurs is likewise unfavorable since sanding machines of this type are usually never used uniformly over the available working width. Therefore, segmented belts having the width of a wide belt cause high costs and do not offer process-related variation possibilities.

With the forgoing problems and concerns in mind, it is the general object of the present invention to provide a sanding station of the type mentioned at the beginning, in which the sanding belt and the segmented belt can be driven independently of one another such that there results a uniform wear and that the operation can be performed with a cost-efficient design of the segmented belt.

SUMMARY OF THE INVENTION

According to one embodiment of the present invention, the running direction of the pressure segment belt is oriented transversely to the running direction of the sanding belt. In the case of a wide belt sanding machine this means that the segmented belt circulates transversely to the transport direction of the workpiece and to the running direction of the sanding belt and is guided over separate deflection and drive rollers. In a manner known per se, the segmented belt can consist of segments oriented diagonally with respect to the running direction. In order to reduce the friction between the sanding belt and the segmented belt it is useful to provide a friction reducing sliding layer between the segmented belt and the sanding belt.

The advantage of the solution according to the invention is that compared with the width of the sanding belt, a relatively narrow segmented belt can be used which is substantially cheaper than a segmented belt having the width of the sanding belt. In addition, the circulation speed of the segmented belt can be chosen and varied completely independently of the circulation speed of the sanding belt in order to guarantee that the two belts do not circulate in a fixed ratio with respect to one another, which could result in the formation of a pattern or in a periodic increased wear on the sanding belt.

Further, the invention relates to a belt sanding machine for planar workpieces which run through the belt sanding machine in a predetermined direction, the belt sanding machine including at least one sanding station of the before-mentioned type.

Preferably, the sanding station is implemented as a wide belt sanding station having a sanding belt circulating parallel to the running direction of the workpiece, which sanding belt substantially extends over the working width of the belt sanding machine and is guided over rollers which are oriented transversely to the running direction of the workpiece.

The sanding station according to the invention can, in a simple manner, also be implemented such that it can be operated both with a wide belt as well as with a cross belt. With regard thereto, it is suggested according to the invention that the sanding station has at least a further guide and drive roller for a cross sanding belt running parallel to the pressure segment belt and transversely to the running direction of the workpiece. As a result, one and the same sanding station can quickly and comfortably be converted from a wide belt sanding station into a cross belt sanding station and vice versa merely by the fitting of different sanding belts. As a result, the user of the belt sanding machine saves costs and space required for a further sanding machine.

DETAILED DESCRIPTION OF THE PREFERRED EMBODIMENT

Figure 1:
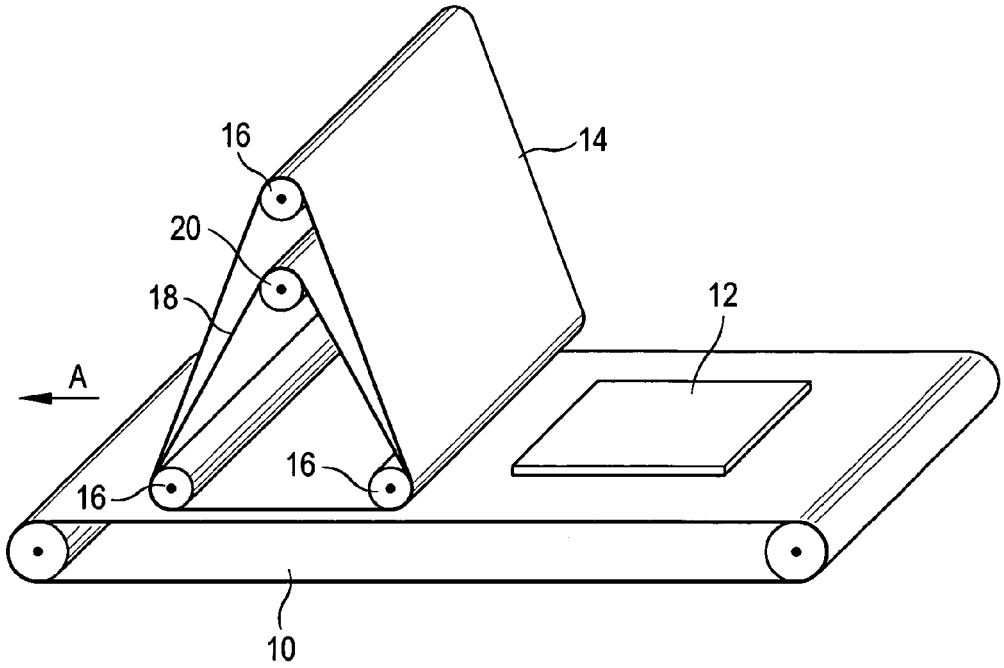
FIG. 1 is a schematic illustration of a conventional wide belt sanding station having a segmented belt.

In FIG. 1, a transport belt is referenced by 10 with which a workpiece 12 can be guided through below a sanding belt 14 in the direction of the arrow A. This sanding belt 14 is guided over three deflection rollers 16 which are oriented transversely to the running direction A of the transport belt 10 so that it circulates parallel to the running direction of the transport belt, over the entire width of the transport belt 10.

A segmented belt 18 which is guided over two of the same deflection rollers 16 as well as over a separate third deflection roller 20 circulates within the sanding belt 14. The width of the segmented belt 18 corresponds to the width of the sanding belt 14. This solution has the disadvantages described above, which can be remedied with the inventive solution illustrated in FIG. 2. Here, identical parts have identical reference characters. In contrast to the solution according to FIG. 1, the segmented belt 18 is oriented transversely to the running direction A of the transport belt 10 and of the sanding belt 14, i.e. it runs over two deflection rollers 22, the axes of which extend parallel to the transport direction A of the workpiece 12. The segmented belt 18 is substantially narrower than the segmented belt used in the known embodiment according to FIG. 1. In a manner known per se, it can be formed of segments 24 which are oriented diagonally to the direction of circulation of the segmented belt 18. A sliding layer 26 is provided between the segmented belt 18 and the inner side of the sanding belt 14 in order to reduce the friction between the belts circulating transversely to one another.

Figure 2:
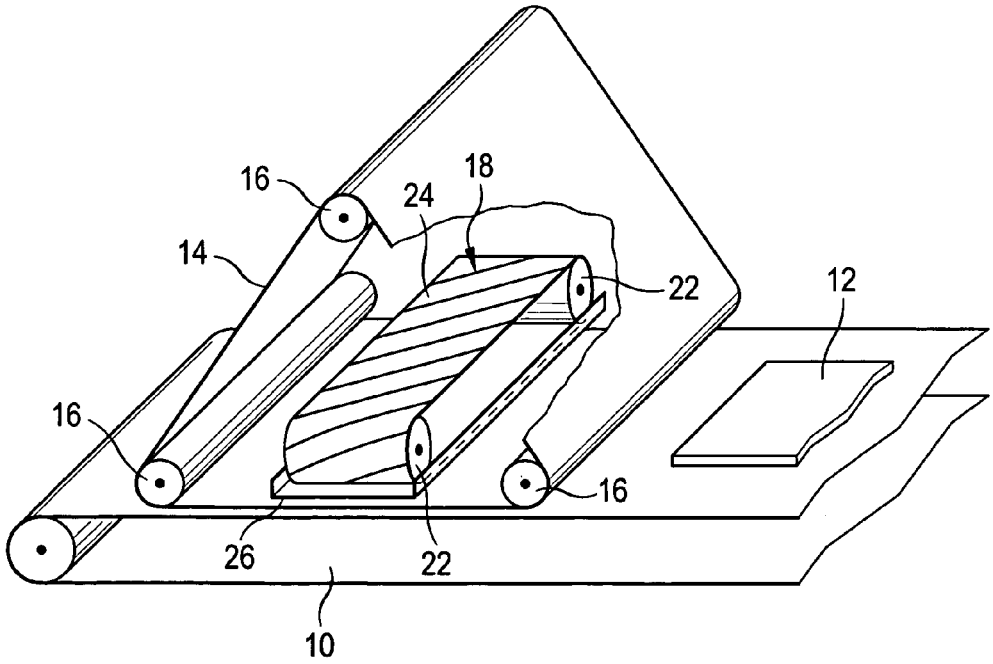
FIG. 2 is an illustration corresponding to the one of FIG. 1 and illustrates the solution according to the invention.
Figure 3:
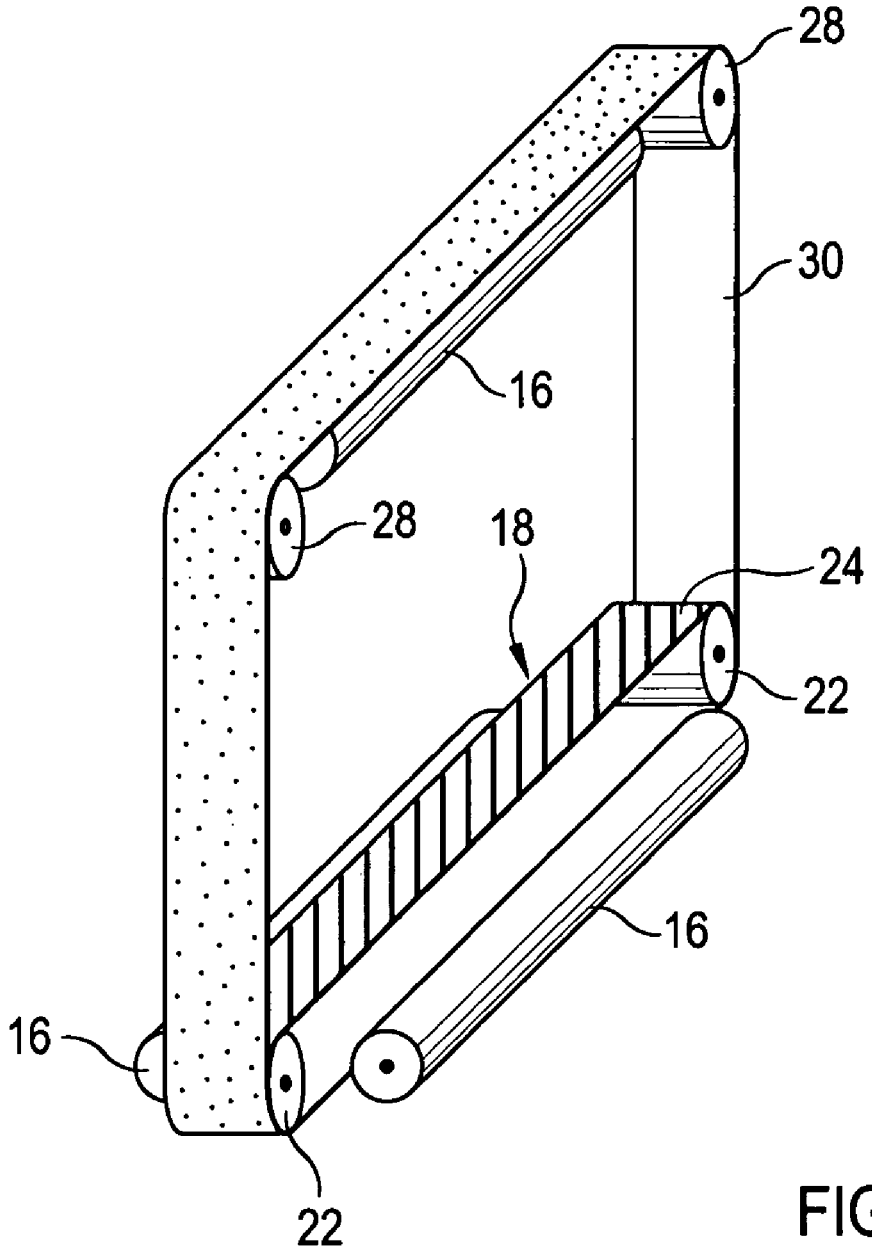
FIG. 3 is a further schematic illustration of a modified embodiment of the sanding station according to the invention.

FIG. 3 schematically illustrates the sanding station illustrated in FIG. 2 without the wide sanding belt 14, identical parts again having identical reference characters. The sanding station has two additional deflection rollers 28, the axes of which running parallel to the axes of the rollers 22. These deflection rollers 28 serve for the guidance and the drive of a cross sanding belt 30 circulating parallel to the pressure segment belt 24. By removing the wide sanding belt 14 and by fitting the cross sanding belt 30, the wide belt sanding station illustrated in FIG. 2 can easily be converted into a cross belt sanding station illustrated in FIG. 3. Thus, one and the same belt sanding station can be used for two different sanding processes at little additional expense. This not only saves costs but also space.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all equivalent embodiments.

What is claimed is:

1. A sanding station for a belt sanding machine, comprising:

at least one endless sanding belt guided over deflection rollers;

a pressure segment belt circulating within said sanding belt for pressing said sanding belt against a workpiece;

a sliding layer provided between said pressure segment belt and said sanding belt; and wherein a running direction of said pressure segment belt is oriented transversely to a running direction of said sanding belt.

2. The sanding station according to claim 1, wherein:

segments of said pressure segment belt are oriented diagonally to its running direction.

3. The sanding station according to claim 2, further comprising:

a sliding layer provided between said pressure segment belt and said sanding belt.

4. A belt sanding machine for planar workpieces which run through said belt sanding machine in a predetermined direction A, comprising:

an endless sanding belt guided over deflection rollers;

a pressure segment belt circulating within said sanding belt for pressing said sanding belt against a workpiece;

a sliding layer provided between said pressure segment belt and said sanding belt; and wherein a running direction of said pressure segment belt is oriented transversely to a running direction of said sanding belt.

5. The belt sanding machine according to claim 4, wherein:

segments of said pressure segment belt are oriented diagonally to its running direction.

6. The belt sanding machine according to claim 4, wherein:

said sanding station is implemented as a belt sanding station having a wide sanding belt circulating parallel to said predetermined direction A of said workpiece, said wide sanding belt extending substantially over a working width of said belt sanding machine and being guided over rollers oriented transversely to said predetermined direction A of said workpiece.

7. The belt sanding machine according to claim 6, wherein:

said sanding station includes at least one further guide and drive roller for a cross sanding belt circulating parallel to said pressure segment belt and transversely to said predetermined direction A of said workpiece.

8. A sanding station for a belt sanding machine, comprising:

at least one endless sanding belt guided over deflection rollers;

a pressure segment belt circulating within said sanding belt for pressing said sanding belt against a workpiece, segments of said pressure segment belt being oriented diagonally to its running direction;

a sliding layer provided between said pressure segment belt and said sanding belt; and wherein a running direction of said pressure segment belt is oriented transversely to a running direction of said sanding belt.

* * * * *